US005820385A

United States Patent [19]

Ohashi et al.

[11] Patent Number: 5,820,385

[45] Date of Patent: Oct. 13, 1998

[54] MAGNETIC DISPLAY APPARATUS

[75] Inventors: Michiya Ohashi; Takao Namiki, both of Tokyo, Japan

[73] Assignee: Tomy Company, Ltd., Tokyo, Japan

[21] Appl. No.: 583,632

[22] Filed: Jan. 5, 1996

[30] Foreign Application Priority Data

Jan. 13, 1995 [JP] Japan ..... 7-000475 U

[51] Int. Cl.[6] ..... B43L 1/00

[52] U.S. Cl. ..... 434/409; 434/408

[58] Field of Search ..... 434/409, 408, 434/417

[56] References Cited

U.S. PATENT DOCUMENTS 4,288,936 9/1981 Okutsu ..... 434/409 X 4,675,476 6/1987 Kobayashi ..... 434/409 X 5,186,631 2/1993 Okutsu ..... 434/409

*Primary Examiner*—Jeffrey A. Smith

*Attorney, Agent, or Firm*—Staas & Halsey

[57] ABSTRACT

A magnetic display apparatus having a magnetic display sheet consisting of a plurality of microcapsules having oily liquid having photoabsorptive ferromagnetic powder and photoreflective non-magnetic powder, an apparatus for erasing with a magnet a line drawn on the display sheet by the magnetic pen, a magnet, a mechanism for moving the magnet along a major portion of the magnetic display sheet and a power source for moving the mechanism which supports the magnet.

5 Claims, 10 Drawing Sheets

PRIOR ART

MAGNETIC DISPLAY APPARATUS

BACKGROUND AND SUMMARY OF INVENTION

The present invention relates to a magnetic display apparatus which is provided with a display sheet and an erasing mechanism therefor.

Magnetic display devices are well known in the art, and include a display sheet consisting of a plurality of microcapsules containing oily liquid having photoabsorptive, ferromagnetic powder and photoreflective, non-magnetic powder mixed therewith. A magnetic pen, such as that shown in FIGS. 15 and 16 is used to draw pictures and diagrams on the main surface of the magnetic display sheet, while an erasing apparatus is provided to erase the pictures and diagrams from the main surface. The conventional magnetic pen 1 has a holder 2, a nib 3, a seat 4 with a receiving surface 4*a*, a core 5 and a spring 6, configured as shown. Typically the erasing apparatus is separate from the body of the magnetic display apparatus and operated by moving a knob. Thus, a drawing or diagram on the main surface of the magnetic display sheet is erased by manually rubbing the erasing apparatus against the magnetic display sheet, for example, by moving a magnet along the magnetic display sheet by operation of a knob.

Problems arise with manually operated erasing devices. Erasing a diagram or sketch from the main surface of the magnetic display sheet by attracting photoabsorptive ferromagnetic powder in microcapsules by magnetic force or movement of the powder, when such apparatus is manually operated, makes it difficult to control the speed of the erasing apparatus and the proper functioning thereof. If the erasing apparatus is moved too fast, it is not possible to clearly erase the sketch or diagram because the effect of the magnetic force is not sufficient with respect to the photoabsorptive ferromagnetic powder in the microcapsules, thus requiring repeated operation of the erasing mechanism. On the other hand, if the erasing apparatus is moved too slowly, the diagram or figure drawn on the main surface of the magnetic display sheet can be completely erased, but it is difficult for children, particularly infants, to adjust to the procedure of being required to slowly move the erasing apparatus.

It is an object of the present invention to provide a magnetic display apparatus having an erasing mechanism which can be operated easily by young children to clearly erase a diagram or figure from the main surface of the magnetic display sheet. In accordance with the principles of the present invention the magnetic display apparatus includes a magnetic display sheet achieved by congesting a plurality of microcapsules in which oily liquid having photoabsorptive ferromagnetic powder and photoreflective non-magnetic powder are mixed together and sealed, and an apparatus for erasing with a magnet the diagram or picture which has been drawn with the use of a magnetic pen. The erasing apparatus is part of the display apparatus and includes a power source and a mechanism for moving a magnet along the main portion of the magnetic display sheet. The magnet moving mechanism includes a rack provided along a moving path of the magnet, a pinion which engages the rack, a spiral spring which is wound up by rotation of the pinion in one direction, a frame to which the pinion and the spiral spring are provided, and a knob on the display apparatus which moves the spring frame along the rack in a winding-up direction, the magnet being connected to the spring frame and moving along the main portion of the magnetic display sheet by the rotation of the pinion in the other direction under the influence of the unwinding force of the spiral spring. In this manner, since the magnet moves along the main portion of the magnetic display sheet by operation of the power source and the magnet moving mechanism at an appropriate speed, the diagram or figure which has been drawn on the display sheet can easily and clearly be erased.

DESCRIPTION OF THE PREFERRED EMBODIMENT

Figure 1:
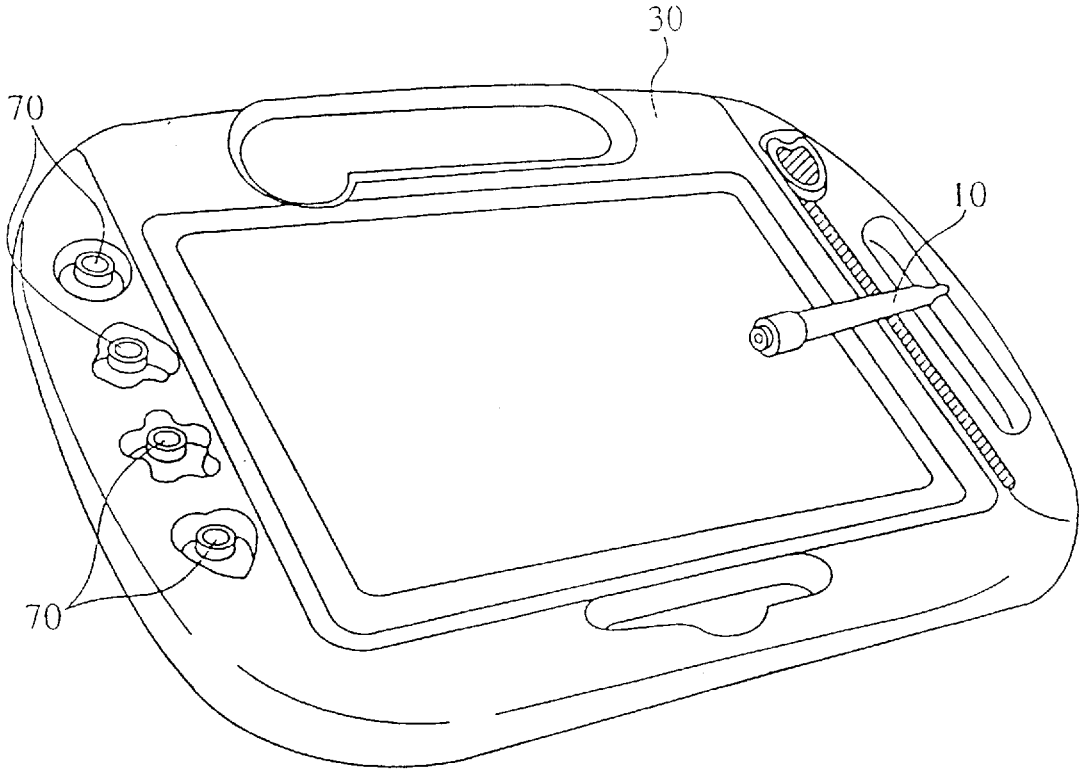
FIG. 1 is a perspective view illustrating the magnetic display apparatus and magnetic pen of an embodiment of the invention.

The magnetic pen is designated generally by the reference numeral 10, as seen in FIGS. 1–4. The pen 10 is provided with a core member 11 which includes a spherical resin crown at one end thereof. A disc type magnet 12 is embedded in the surface 11*a* of the core member 11.

Figure 3:
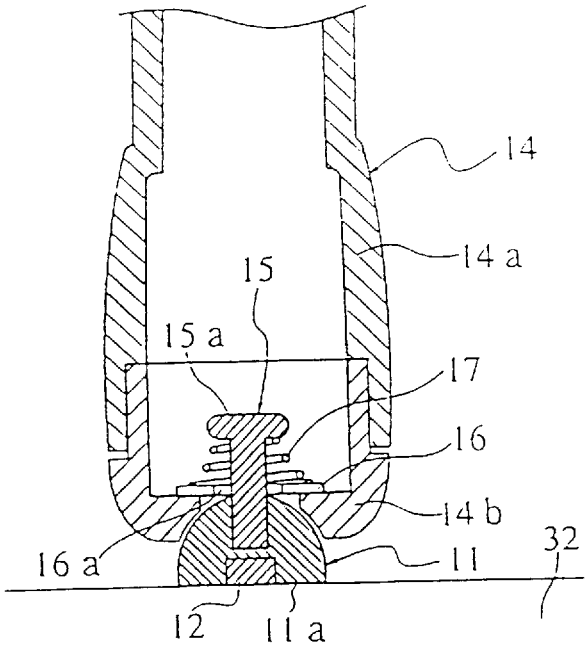
FIG. 3 is a vertical sectional view of a portion of the magnetic pen.
Figure 4:
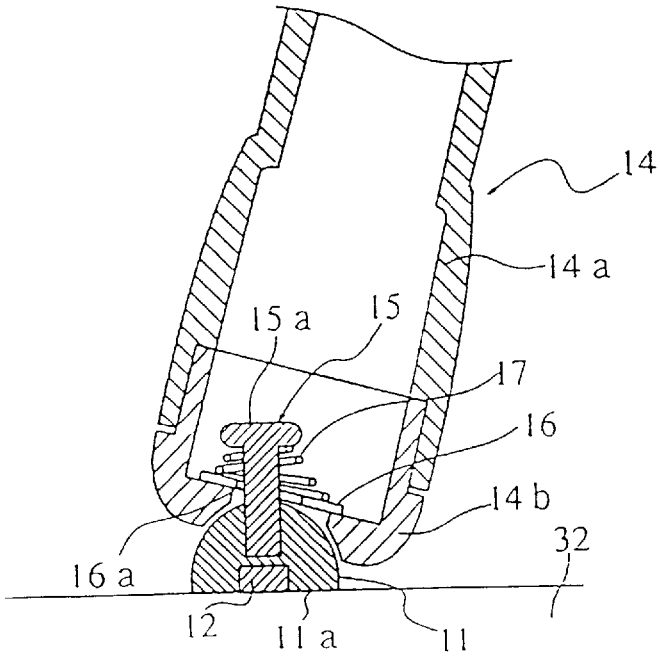
FIG. 4 is a vertical sectional view of one end of the magnetic pen when inclined to the display sheet.

The core member 11 is supported within the body 14 such that the surface 11*a* protrudes from the tip of the body 14. One side of the body 14 is provided with a holder 14*a* and a nib 14*b*. The core member 11 is positioned within a central opening of the nib 14*b*. A shaft 15 having a head 15*a* is provided within the spherical surface of the core member 11, the shaft 15 being inserted into the interior of the nib 14*b* through the hole 16*a* of the washer 16. A spring 17 is wound around the shaft 15 between the head 15*a* and the washer 16. The core member 11 is thereby supported by the body 14 through the force of the spring 17. The plane surface 11*a* of the core member 11 can thereby be brought into contact with the main surface of the magnetic display sheet, as seen in FIGS. 3–4, when drawing a line, irrespective of the inclination of the body 14, as can be seen in FIGS. 3 and 4.

Figure 2:
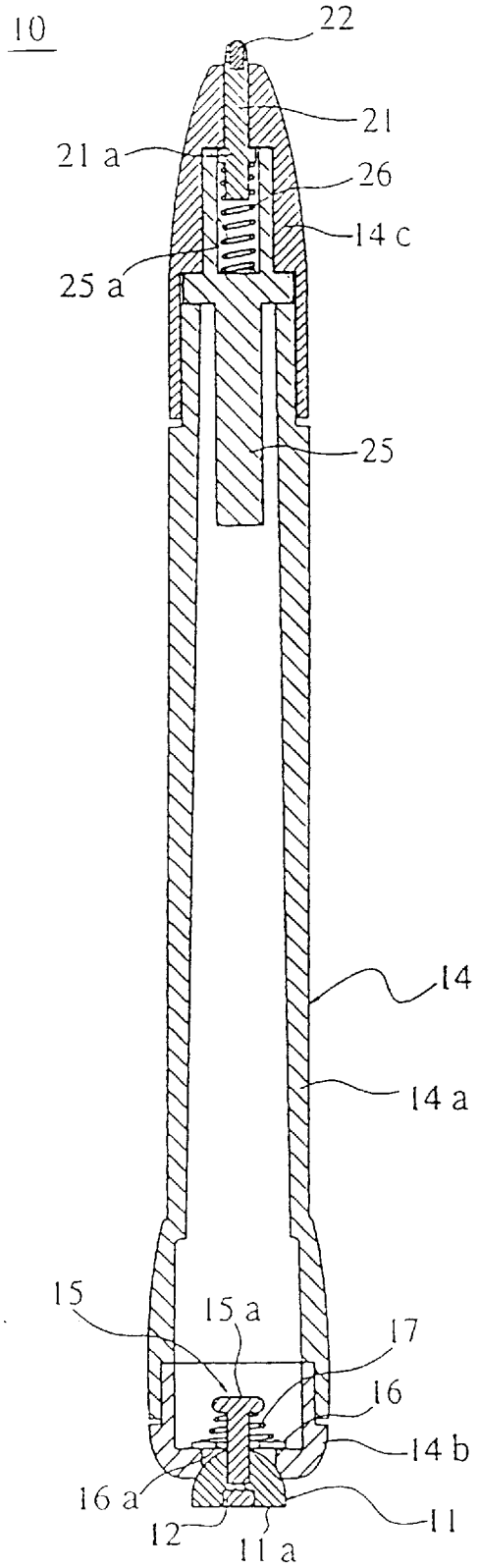
FIG. 2 is a vertical sectional view of the magnetic pen.

As seen in FIG. 2, the core member 21 is provided with a tip which includes a magnet 22. The core member 21 is configured such that the magnet 22 is embedded in the center thereof which is made of brass.

The core member 21 is supported by the body 14 such that it can move in a direction permitting the tip magnet 22 of the core member 21 to spring out of or be pulled into the tip of the body 14. The other side of the body 14 consists of the holder 14*a*, the nib 14*c* and a middle seat 25 which is positioned between the holder 14*a* and the nib 14*c*. A receiving portion 25*a* is formed in the middle seat 25. A spring 26 is provided in the core receiving portion 25*a* and urges the core member 21 towards the tip. A flange-type stopper 21*a* is disposed within the core member 21 and is urged against the inner surface of the nib 14*c*.

The holder 14*a*, the nibs 14*b* and 14*c* and the middle seat 25 are made of a hard resin, whereas the washer 16 is made of metal. The magnets 12 and 22 are neodymium-type magnets of alloy obtained from neodymium, iron and boron, of alloy obtained from a rare earth element called samarium and cobalt, or rare earth magnets using praseodymium. Use of these magnets enables the clear display of thin lines.

Figure 6:
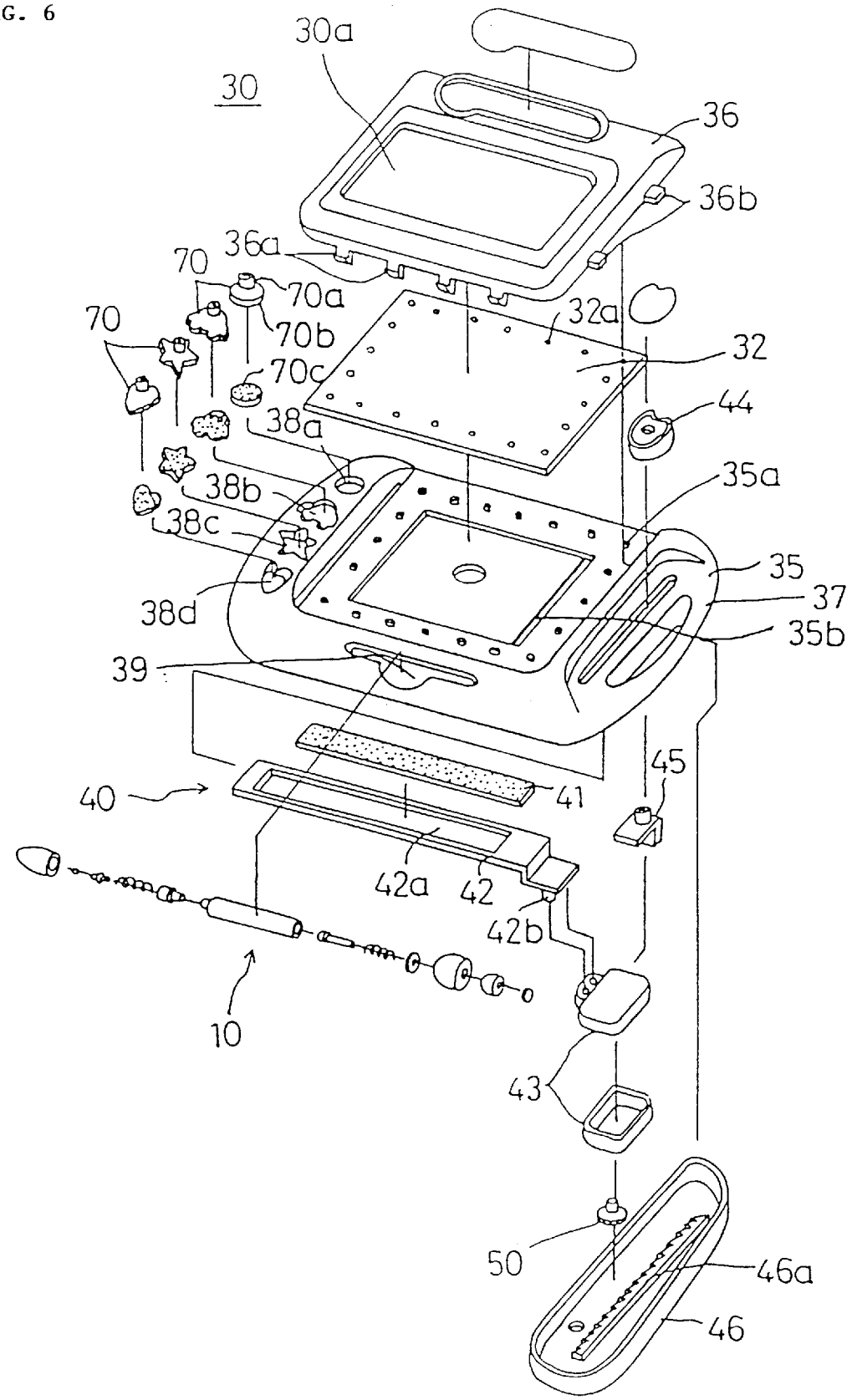
FIG. 6 is an exploded perspective view of the components of the magnetic display apparatus.

As seen in FIG. 1, the magnetic display apparatus 30 is generally flat in configuration. As seen in FIG. 6, a rectangular window 30*a* is provided on the display apparatus 30 at the upper, central portion thereof. A major portion of the magnetic display sheet 32 is thereby exposed through the window 30*a*. A handle 37 is formed on the upper right side of the display apparatus 30. Concave recesses 38*a* through 38*d* are provided on the upper, left side. A concave recess 39 for holding the pen 10 is formed on the upper front side thereof.

Figure 5:
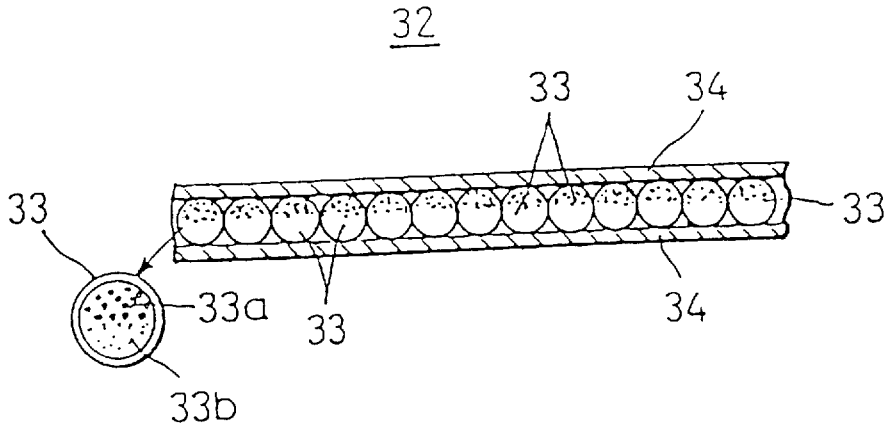
FIG. 5 is a sectional view of a portion of the magnetic display sheet.

As seen in FIG. 5, the magnetic display sheet 32 comprises a plurality of sandwiched microcapsules 33 in which are mixed oily liquid having photoabsorptive ferromagnetic powder 33*a* and photoreflective non-magnetic powder 33*b* sealed by thin-film protective sheets 34 having magnetic permeability and light transmissibility. The protective sheets 34 are forced to adhere to each other with the use of high frequency welding. The protective sheet 34 on the rear side may not have light transmissibility.

A plurality of punched holes 32*a* are formed at the outer peripheral portion of the magnetic display sheet 32, as seen in FIG. 6. Bosses 35*a* are provided on the base 35 of the magnetic display 30 and fit in the punched holes 32*a*. The upper end portions of the bosses 35*a* protrude through the punched holes 32*a* and are engaged within holes (not shown) formed on the rear side of the window frame 36. With such a configuration, the magnetic display sheet 32 is held between the base 35 and the window frame 36. The window frame 36 is attached to the base 35 by engaging the projections 36*a* or claws 36*b* of the window frame 36 with the engagement holes (not shown) of the base 35.

As further illustrated in FIG. 6, an erasing apparatus generally designated by the reference numeral 40 is provided with an elongated magnet 41 which preferably is a neodymium magnet made of alloy obtained from neodymium, iron and boron, an alloy obtained from a rare earth element called samarium and cobalt, or a rare earth magnet using praseodymium. The magnet 41 engages the concave portion 42*a* of a holder 42. A step portion is formed at the right end of the holder 42, as seen in FIG. 6. The magnet holding portion of the holder 42 is positioned below the display sheet 32 through the slit 35*b* formed in the base 35. The right end of the holder 42 is positioned below the base 35. Bosses 42*b* are positioned on the lower side of the right end of the holder 42 and are positioned within holes formed in the spring frame 43.

As seen in FIG. 6, the spring frame 43 engages a knob 44 which moves along the slit 35*b*. A hook-type member 45 which is integral with the knob 44 is provided below the base 35. When the knob 44 is pulled toward the front side, the hook type member 45 is first brought into contact with the spring frame 43. The spring frame 43 is moved towards the front side integrally with the knob 44. Movement of the spring frame 43 is guided by the rear frame 46 which has a rack 46*a* provided therein.

Figure 7:
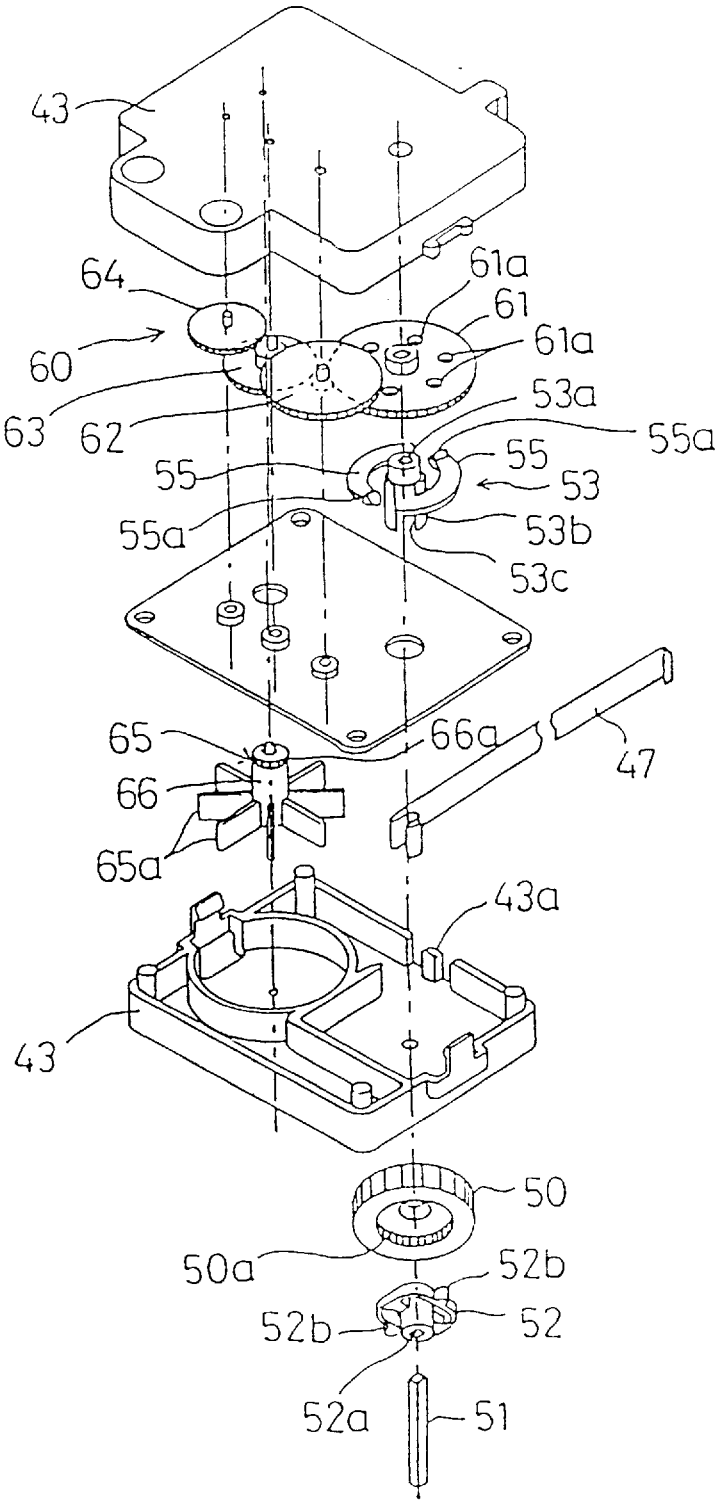
FIG. 7 is an exploded perspective view of the spring mechanism.
Figure 11:
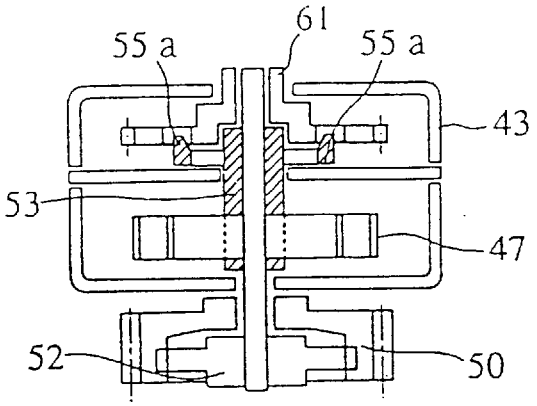
FIG. 11 is a vertical sectional view of the spring frame.
Figure 12:
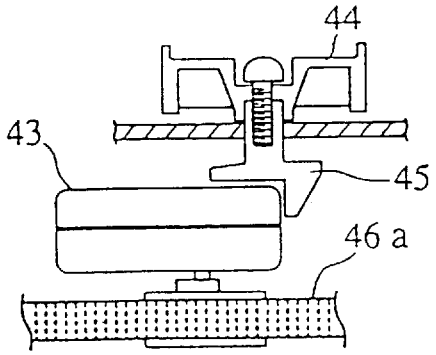
FIG. 12 is a side elevational view depicting the relationship between the knob and the spring frame.
Figure 13:
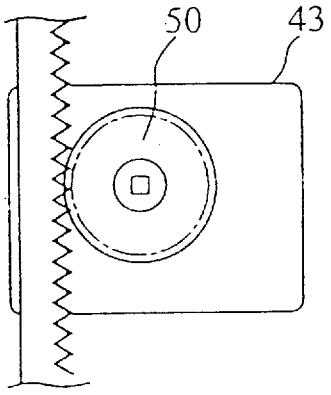
FIG. 13 is a bottom view illustrating engagement between the rack and spring frame.

As illustrated in FIG. 7, a power source in the form of a spiral spring 47 is positioned within the spring frame 43. The spiral spring 47 is wound up by movement of the spring frame 43 toward the front side. That is, a pinion 50 which functions as a winding-up mechanism is provided below the spring frame 43, as seen in FIGS. 11 and 13. The pinion 50 engages the rack 46*a*. The pinion 50 rolls on the rack 46*a* when the spring frame 43 moves toward the front side. The pinion 50 is attached to an angular shaft 51 so as to be capable of idling and engages a bi-directional clutch 52 which is fixed to the annular shaft 51. A hole 52*a* through which the annular shaft 51 is inserted is formed in the bi-directional clutch 52. A pair of claws 52*b* are provided on the bi-directional clutch 52 and engage the inner circumferential teeth 50*a* of the pinion 50. In this manner, rotation of the pinion 50 rotates the annular shaft 51 through the bi-directional clutch 52. Furthermore, a single-directional clutch 53 is fixed to the annular shaft 51 via hole 53*a*. To a shaft portion 53*b* of the single-directional clutch 53 is formed a slit 53*c* at which end the spiral spring 47 is positioned. The other end of the spiral spring 47 is caught at the projection 43*a* which is provided at the spring frame 43. The spiral spring 47 is wound up when the angular shaft 51 rotates. A pair of sickle-type elastic pieces 55 are provided at the shaft portion 53*b* of the single-directional clutch 53. On the top face of the tip of each sickle-like elastic piece 55 is found a projection 55*a* having one side inclined so as to have a downward pitch toward the tip of the elastic piece 55.

Figure 8:
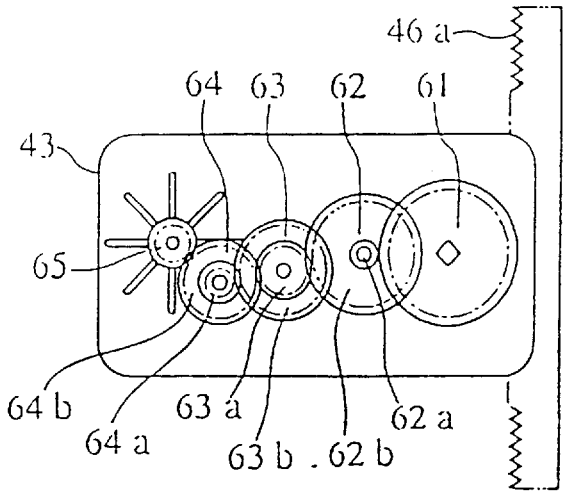
FIG. 8 is a plan view showing the mechanism within the spring frame.
Figure 9:
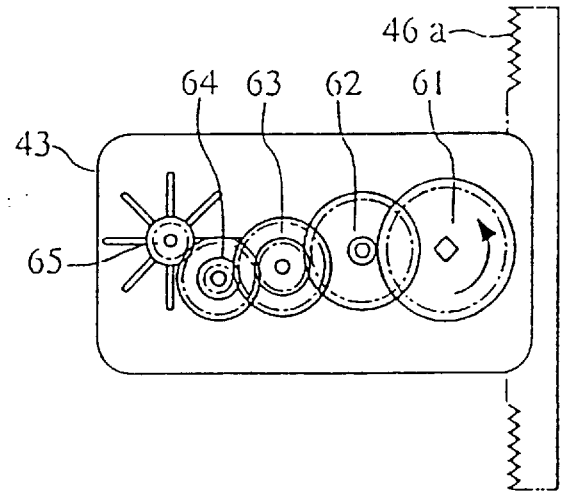
FIG. 9 is a plan view depicting operation of the mechanism within the spring frame.
Figure 10:
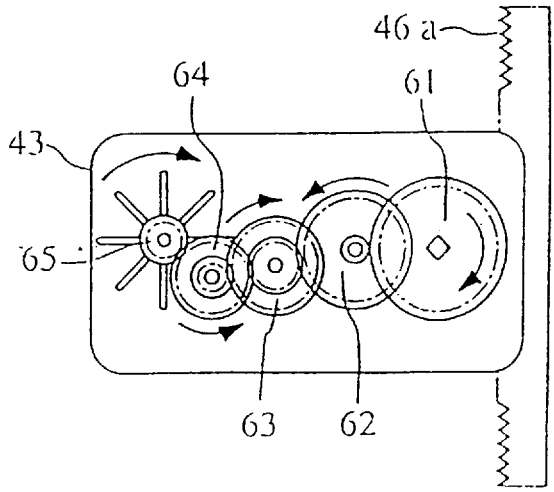
FIG. 10 is a plan view illustrating operation of the mechanism within the spring frame in the opposite direction.

A speed governing mechanism 60 is connected to the single-directional clutch 53 and is provided within the spring frame 43. The speed governing mechanism 60 consists of a first gear 61, a second gear 62, a third gear 63, a fourth gear 64 and an impeller 65. Rotation of the single-directional clutch 53 rotates the impeller 65 through the first gear 61, the second gear 62, the third gear 63 and the fourth gear 64 when the spiral spring 47 is unwound. The first gear 61 is attached to the angular shaft 51 so as to be capable of idling. A plurality of holes 61*a*, with which projections 55*a* of the single-directional clutch 53 are formed, are connected to the first gear 61. Engagement between the projections 55*a* and the holes 61*a* is released when the single-directional clutch 53 rotates in a direction such that the spiral spring 47 is wound up and the first gear 61 does not rotate (FIG. 9). On the other hand, when the single-directional clutch 53 rotates in a direction such that the spiral spring 47 is unwound, the projections 55*a* engage the holes 61*a* and the first gear 61 rotates with the single-directional clutch 53 (FIG. 10). The rotational power of the first gear 61 is transmitted to the impeller 65 through the second gear 62, the third gear 63 and the fourth gear 64. As can be seen in FIG. 8, the first gear 61 engages the small gear 62*a* of the second gear 62; the large gear 62*b* of the second gear 62 engages the small gear 63*a* of the third gear 63; the large gear 63*b* of the third gear 63 engages the small gear 64*a* of the fourth gear 64; and the large gear 64*b* of the fourth gear 64 engages the gear 66*a* provided at the shaft portion 66 of the impeller 65. Although each blade 65*a* of the impeller 65 is substantially the same length, as seen in FIGS. 8 and 9, the lengths of these respective blades 65*a* are actually different from each other. The rotation of the impeller 65 functions as a resistance mechanism when the spiral spring 46 is unwound. It is understood that the knob 44, the hook-type member 45, the rack 46*a* and the various mechanisms provided for the spring frame 43 function as a magnet moving mechanism.

As can be seen in FIG. 6, magnet stamps 70 are provided for the stamp recesses 38*a*–38*d* and are configured such that the magnets 70*c* are disposed below the body 70*b* to which the knob portions 70*a* are provided. The magnetic stamps 70, as seen in FIG. 1, include the shape of a circle, the shape of a car, the shape of a star and the shape of a heart. The stamp recesses 38*a*–38*d* have the same shapes and thus correspond to the stamps 70.

Use of the magnetic pen 10 and display 30 will now be described. After the knob 44 is pulled toward the front side, the hand is removed therefrom. During the time the knob 44 is pulled toward the front side, the magnet 41 supported on the holder 42 is also pulled toward the front side. During this time, the inner spiral spring 47 is wound up. After the hand is removed from the knob 44 the unwinding force of the spiral spring 47 moves the magnet 41 supported on the holder 42 toward the back side. In this way the magnet 41 reciprocates frontwards and backwards below the magnetic display sheet 32, the photoabsorptive ferromagnetic powder being concentrated on the front side thereof. Thus, the surface on which the photoabsorptive ferromagnetic powder is concentrated, i.e., the rear surface, is blackened while the surface on which the photoreflective, non-magnetic powder is concentrated, i.e., the front surface, is whitened.

Thereafter, when the surface of the magnetic display sheet 32 is rubbed with the magnetic pen 10, the photoabsorptive ferromagnetic powder in the microcapsules is magnetically attracted to the surface, blackening the rubbed part. On the other hand, if the rubbed part is viewed from the rear side, the corresponding part looks white. Therefore, patterns, characters, etc., are displayed. Although either of the pens of the magnetic pen 10 can be used, no disturbance is generated from the inclination of the body 14 of the pen when the pen is close to the core member 11. That is, the plane surface 11*a* of the core member 11 is brought into contact with the surface of the magnetic display sheet 32 irrespective of the inclination of the pen body 14. On the other hand, when the pen close to the core member 21 is used, the body 14 must be substantially orthogonally positioned on the magnetic display sheet 32. When using the pen of the core member 11 a relatively thick line of fixed width is achieved.

Figure 14:
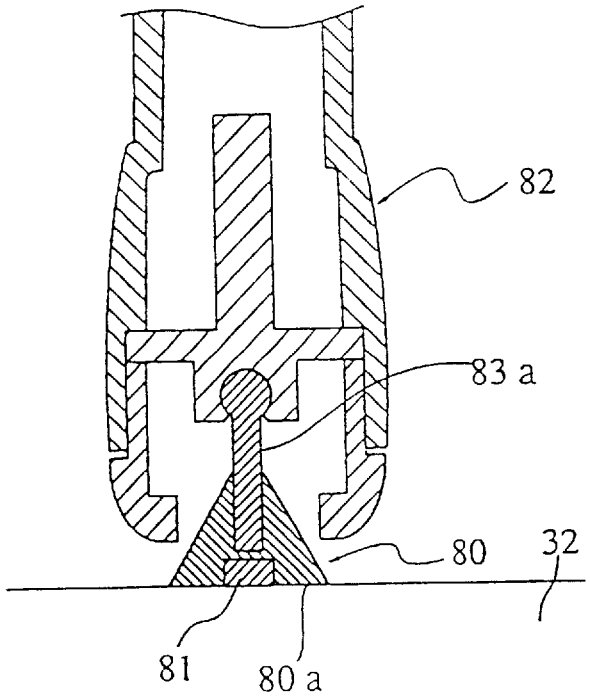
FIG. 14 is a vertical sectional view of part of the magnetic pen in accordance with a further embodiment of the present invention.
Figure 15:
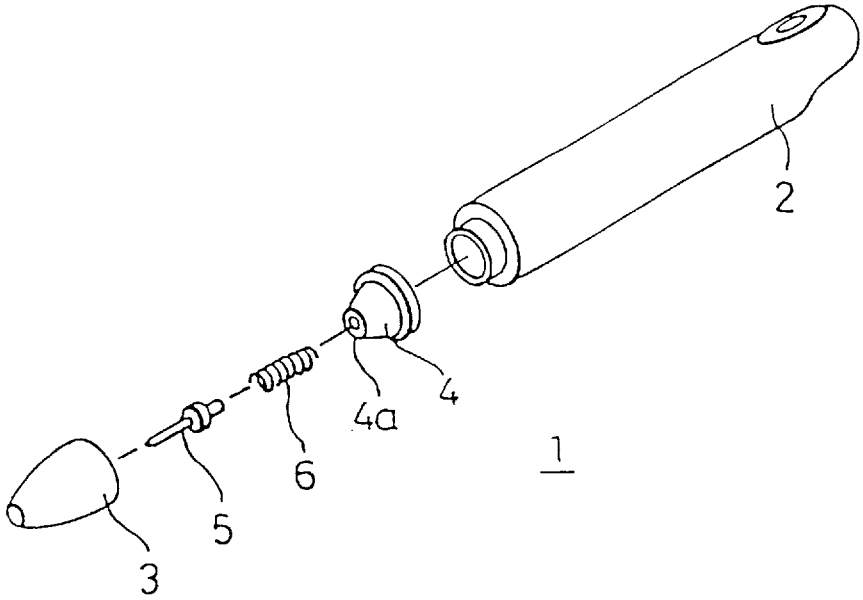
FIG. 15 PRIOR ART
FIG. 15 is an exploded perspective view of a conventional magnetic pen.
Figure 16:
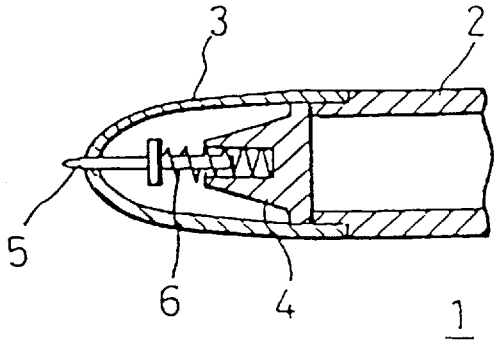
FIG. 16 is a sectional view of the tip of a conventional magnetic pen.

It is understood that the principles of the present invention are not limited to the preferred embodiment. Various modifications are possible without departing from the scope of the present invention. For example, although the core member 11 has a spherical crown shape it will be apparent that the core member may have a plane surface; at least a part of the plane surface 80*a* may consist of the magnet 81; the core member 80 may be supported by a pen body such that the plane surface of the core member protrudes from a tip of the pen body and a spherical contraposition is generated by a spherical tip of a shaft 83*a* erected on the rear end of the core member 80 and the pen body; and that the plane surface 80*a* of the core member may be brought into contact with a main surface of the magnetic display sheet 32 by the strength of a stroke when drawing a diagram or the like, as illustrated in FIG. 14.

Although the spiral spring 47 is used as the power source of the erasing apparatus 40 it will be apparent that a motor or similar structure may be employed.

What is claimed is:

1. A magnetic display apparatus comprising:

a magnetic display sheet on which a line can be drawn with a magnetic pen;

a magnet;

a rack extending along one side of the magnetic display sheet;

a pinion connected to the magnet and engaged with the rack for rotating in first and second directions with movement relative to the rack, to move the magnet along the magnetic display sheet;

a spiral spring wound up by rotation of the pinion in the first direction; and a knob device connected to the pinion for moving the pinion relative to the rack, rotating the pinion in the first direction and winding the spiral spring such that release of the knob device causes the spiral spring to unwind, the pinion to rotate in the second direction and the magnet to move along the magnetic display sheet.

2. A magnetic display apparatus according to claim 1, wherein the knob device is connected to the pinion by means of a hook type member which operatively connects with the pinion when the knob device is moved in one direction, and which is released from the pinion when the knob device is moved in a second direction.

3. A magnetic display apparatus according to claim 1, wherein the magnetic display sheet extends between length and width generally perpendicular directions, the rack extending in the length direction and the magnet moving in the width direction.

4. A magnetic display apparatus according to claim 1, further comprising:

a magnet holder having a concave portion for holding the magnet, and bosses; and a spring frame for accommodating the spiral spring, the spring frame having indentations receiving the bosses of the magnet holder, the spring frame having an opening for operative connection of the spiral spring and the pinion.

5. A magnetic display apparatus according to claim 1, further comprising:

a single directional clutch for transmitting a rotation force only when the pinion rotates in the second direction; and a speed governor connected to the single directional clutch to operate only when the pinion rotates in second direction to control the speed of rotation in the second direction.

* * * * *